US008282101B2

(12) United States Patent
Snoddy et al.

(10) Patent No.: US 8,282,101 B2
(45) Date of Patent: Oct. 9, 2012

(54) UNIVERSAL PUZZLE PIECE FOR INTERACTIVE ENTERTAINMENT

(75) Inventors: Jon Hayes Snoddy, Pasadena, CA (US); Lanny S. Smoot, Thousand Oaks, CA (US); Scott Frazier Watson, Marina De Rey, CA (US)

(73) Assignee: Disney Enterprises, Inc., Burbank, CA (US)

( * ) Notice: Subject to any disclaimer, the term of this patent is extended or adjusted under 35 U.S.C. 154(b) by 102 days.

(21) Appl. No.: 13/017,898

(22) Filed: Jan. 31, 2011

(65) Prior Publication Data

US 2012/0196661 A1 Aug. 2, 2012

(51) Int. Cl.
*A63F 1/10* (2006.01)

(52) U.S. Cl. ..... 273/156

(58) Field of Classification Search ..... 273/156
See application file for complete search history.

(56) References Cited

U.S. PATENT DOCUMENTS

| | | | | |
|---|---|---|---|---|
| 8,176,924 | B2 * | 5/2012 | Schneider et al. | 132/73 |
| 2008/0246748 | A1 * | 10/2008 | Cassidy et al. | 345/205 |
| 2010/0026458 | A1 | 2/2010 | Samdahl et al. | |
| 2010/0130286 | A1 | 5/2010 | Ackley et al. | |
| 2010/0130296 | A1 | 5/2010 | Ackley et al. | |
| 2010/0144413 | A1 | 6/2010 | Purvis et al. | |
| 2012/0092127 | A1 * | 4/2012 | Ganapathi et al. | 340/5.53 |

* cited by examiner

*Primary Examiner* — Corbett B Coburn
(74) *Attorney, Agent, or Firm* — Marsh Fischmann & Breyfogle LLP; Kent A. Lembke

(57) ABSTRACT

An interactive entertainment system that includes a universal puzzle piece for each game or activity participant. The puzzle piece includes an updatable display displaying a first graphic image. The system includes an interactive display device with a display surface with an update mechanism that is operable such as by a controller, when the puzzle piece is in a predefined proximate position, to program the updatable display to update the first graphic image into a second graphic image. The updatable display includes an electrophoretic display layer storing the second graphic image. A transparent electrode layer is provided on a first side of the electrophoretic display layer. The update mechanism includes a puzzle piece update pad for receiving a second side of the electrophoretic display. The update pad includes a conductor layer or bottom conductor providing an electrical connection with the second side to provide the update to the first graphic image.

20 Claims, 9 Drawing Sheets

UNIVERSAL PUZZLE PIECE FOR INTERACTIVE ENTERTAINMENT

BACKGROUND

1. Field of the Description

The present description relates, in general, to interactive entertainment, and, more particularly, to systems, devices, and methods for providing location-based entertainment that allows a participant or user to participate with or interact with displayed information (text, images, stimuli, and so on) by physically presenting a universal puzzle piece at an interactive display for real time modification or updating of images and/or text displayed on the universal puzzle piece.

2. Relevant Background

There are many applications where it is desirable to encourage people to move from one geographic location to another within a facility. For example, an entertainment facility such as an attraction at a theme park may find it desirable to move numerous visitors through an attraction over time, and this may be achieved by providing interactive entertainment or games that dynamically move the players or participants through a facility during game play (e.g., each player is collecting clues to try to solve a riddle, enhancing their game state by moving from interactive station to interactive station, and so on). In a shopping store or mall environment, it may be desirable to encourage shoppers to visit differing locations within a store to sample, view, or otherwise experience certain products or displays. Each of these facilities may be thought of as location-based attractions in which it may be useful to shunt or purposefully drive traffic through or about geographic or physical locations of the attraction.

One useful technique for driving traffic within a facility is to provide location-based interactivity that provides a fun way for a player or visitor to gather information in one location that is then useful in another location. For example, this may involve a player of an interactive game being provided a printed game piece such as a map, a game clue, hints for game play, and so on, and the player uses this printed information to play the game such as a treasure hunt or a mystery-solving game. In another example, a player may be encouraged to travel to a particular location that may be associated with an interactive game station, their presence at the first location being detected by a game system, and game information being communicated to and from the player. Unfortunately, triggering installed interactivity in a location-based application such as a theme park can be an expensive proposition.

In some paperless or electronic applications, interactive game or entertainment systems have provided each player with a wireless communication device such as a cellular telephone or the like that was equipped with global positioning satellite (GPS) components. This allowed the system to track the location of the player and also allowed the system to communicate data to the player and the player to communicate data to the game system. GPS-based interactive systems though often were not as effective or useful for indoor settings and often could only provide relatively inaccurate locations (such as within a 30 meter radius). Also, providing each player with a OPS-enabled, two-way communication device causes the system to be very expensive to operate (e.g., each user device may cost well over $100 U.S. dollars), and this requires the system operator to require return of the devices as the player leaves the facility and causes expenses associated with device loss, damage, and maintenance.

In other interactive systems, communication between a player, an off-board game system, and in-facility special effects is achieved by providing each player with a data-enabled, cellphone handset along with an active radio frequency identification (RFID) tag. The cellphone is typically configured to run custom software to process received game data, provide an interactive display on the handset display screen, and process user input via a touch screen or keypad. The battery-powered RFID tag was used to transmit a signal that is accepted by a receiver proximate to a game station, and the signal includes identification data (e.g., a device ID) that is linked by the game system to the particular player. While this allows the location of the player to be accurately determined, use of an active RFID tag adds to the cost of the already expensive cellphone adapted to run game software programs. As with the GPS-based device, the facility operator is forced to collect the handsets/game communication devices as each player leaves the facility and spend money on replacing lost, stolen, damaged, and inoperative devices.

Hence, there remains a demand for additional devices and methods for providing and enhancing an interactive experience at a facility such as a theme or amusement park. Preferably, such devices and methods would include less expensive communication devices that allow users (or players) to interact with interactive stations provided in an entertainment or other interactive facility, e.g., to allow players to participate in an interactive game presented by a game system at one or more geographic locations of a facility such as a theme park or the like.

In some embodiments, it may be desirable for the communication or game-interaction devices to take a form other than a typical communication device so as to enhance the magical or unexpected aspect of the game or interaction (e.g., the prevalence of wireless communication devices such as cellular phones, personal digital assistants, wireless computers, and so on makes it more difficult to surprise or build the curiosity of a game player such that a communication or game device that takes a new form may be desirable).

SUMMARY

To address the above and other problems, an interactive entertainment system is provided that includes a universal puzzle piece (UPP) that may be provided to each user or participant in an interactive game or activity at a venue such as a theme or amusement park. The puzzle piece includes an updatable display displaying a first graphic image (e.g., an initial image that is provided or stored on the puzzle piece at the start of a game or activity). The system also includes an interactive display device with a display surface providing an interactive image or design. The display surface or element includes an update mechanism that is operable (such as by a controller or system server), when the puzzle piece is in a predefined proximate position, to program the updatable display to update the first graphic image into a second graphic image.

In some embodiments of the system, the updatable display includes an electrophoretic display layer (e.g., a layer containing e-ink materials) storing the second graphic image. A transparent electrode layer or continuous conductor is provided on a first side of the electrophoretic display layer. Further, the update mechanism may include a puzzle piece update pad for receiving a second side of the electrophoretic display (e.g., a side opposite the first side). The update pad may include a conductor layer providing an electrical connection with the second side to provide the update to the first graphic image.

Additionally, in some embodiments, the update pad includes a layer of non-conductive, compressible material covering at least portions of the conductor layer such that the electrical connection is only formed when a puzzle piece is pressed against the non-conductive, compressible material layer with a compressive force that is great enough to reduce a thickness of the non-conductive, compressible material layer a predefined amount. In such embodiments, the conductor layer may be an array of conductive pins that are each selectively operable and addressable to have an electric charge to provide the second graphic image. The display surface may include a graphic design and an outer surface of the non-conductive, compressible material layer may include imagery providing a subset of the graphic design of the display surface. Then, the first graphic image may correspond to the imagery on the outer surface such that a user can quickly recognize where to overlay or position their puzzle piece to magically update or change it with the update pad. The updating mechanism may also include a frame adjacent the update pad for contacting and grounding the transparent electrode layer.

According to another aspect, the first graphic image may include a first set of images and a second set of images. In such cases, the updating of the first graphic image may include replacing the second set of images with a third set of images such that the second graphic image includes the first set of images and the third set of images. The third set of images may also be animated, while the puzzle piece is in the predefined proximate position, to further enhance the interactive activity or game. In some cases, the first graphic image includes a text-based message and the second graphic image includes a portion of the text-based message along with an additional set of text that when combined with (or considered in context with) the portion of the text-based message provides a new text-based message (e.g., overlaying the puzzle piece changes a text based message when the display of the puzzle piece is modified by the update mechanism)

DETAILED DESCRIPTION

The present invention involves an interactive entertainment system and associated methods for providing interactive entertainment that encourages users or "players" to move among various locations within a venue (or facility such as a theme or amusement park). The interactive entertainment system includes one or more universal puzzle pieces that are carried (or used) by each player of a game or user of the system. The universal puzzle piece (or UPP) is a portable display onto which information in the form of images, text, animation, and the like (e.g., a puzzle piece, a clue to mystery, and so on) may be loaded, stored, transported, and displayed. The displayed information can be erased and/or modified such that the universal puzzle piece may be updated for differing stages or states of a game or to be reused for another game or activity or by another player.

In some embodiments, the interactive entertainment system also includes an interactive display device with a display surface providing a docking station or puzzle piece-update pad. The station or pad is configured to receive the universal puzzle piece and is controllable to provide information to the user/player by updating or modifying the displayed information. For example, the displayed image may be altered to provide the player with more information regarding an interactive game or activity or information in the form of text may be provided to the player by altering the puzzle piece display.

A number of electronic displays may be used for or as part of the universal puzzle piece. In some embodiments, the puzzle piece includes a liquid crystal display (LCD), a wireless communication device (such as a cellular or wireless phone, a personal communication device adapted for wireless communication such a computer device such as a computer pad or tablet, and so on), a portable game console, a personal digital assistant (PDA)-type device, or other devices that can be programmed or operated to hold and display a graphic and/or textual image In a number of the preferred embodiments, though, the universal puzzle piece includes a display that makes use of some of the concepts of e-paper or e-ink type devices with the interactive display device with its docking surface or update pad functioning to activate the e-paper type device to alter the display (e.g. to update a treasure map, to change or provide a displayed textual message, and so on). With this in mind, the following description begins with a description of such a universal puzzle piece and its use in an interactive entertainment system to provide users or players with a surprising or magical puzzle piece that they are able to transform by placing it in contact with the update pad (with compressive force, in some cases, causing the image/information to change in the display).

Figure 1:
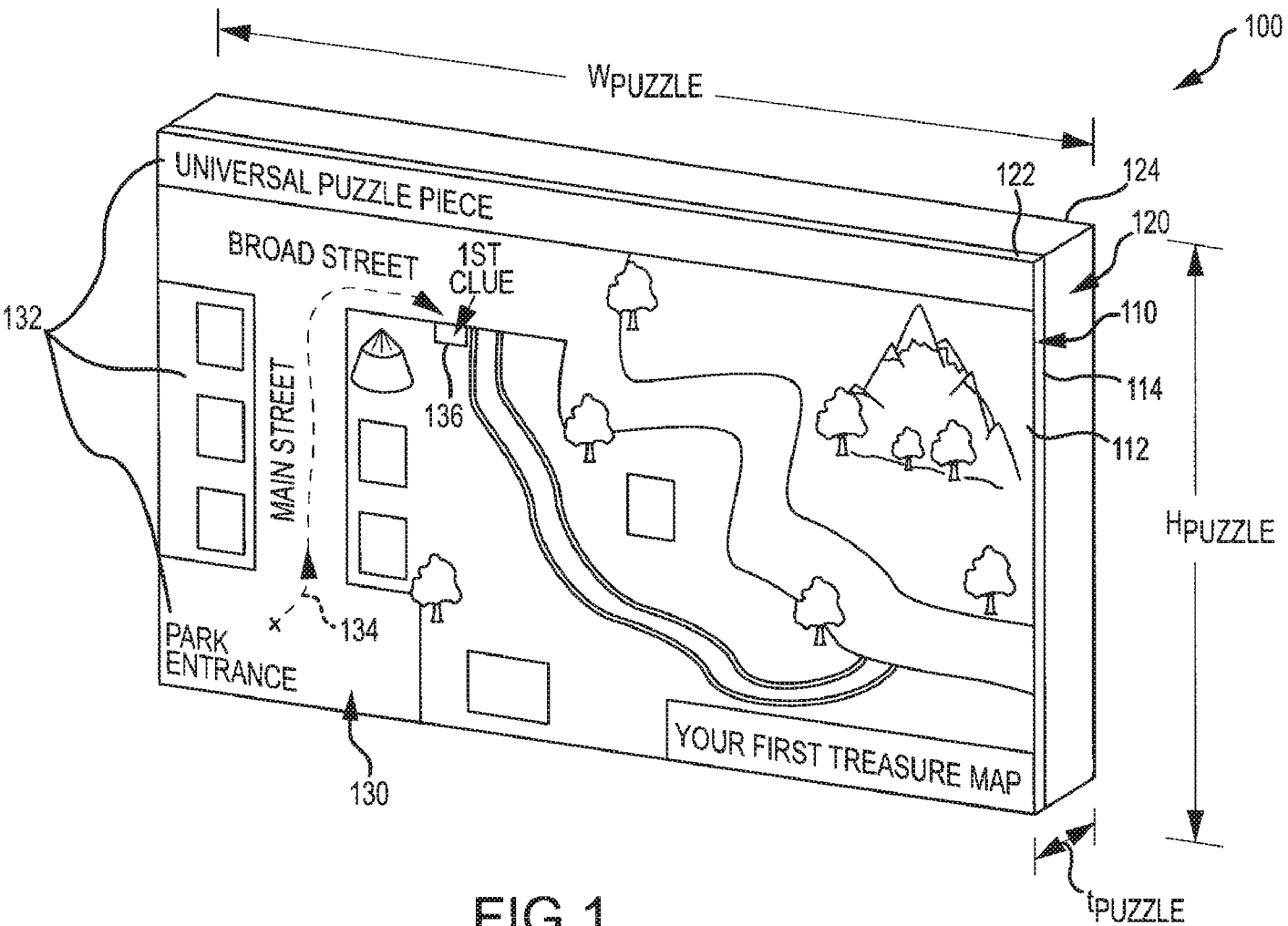
FIG. 1 illustrates a universal puzzle piece of one embodiment showing its use to display a stored set of information (images and text, in this case)

FIG. 1 illustrates one example of a universal puzzle piece 100 of the present invention. The puzzle piece 100 has been operated or "programmed" to provide a display 130 of information. In this example, the displayed information 130 includes a number of relatively permanent or static images and text 132 labeling the device and providing a map of an interactive venue (such as an amusement park). The displayed information 130 also includes less static images and text 134 urging the player or user of the puzzle piece 100 to follow a particular path or route in the mapped venue to find a first clue at identified location 136 (see FIG. 2 for a display of a user/player 206 at the location 136 of the venue 204).

The universal puzzle piece 100 may utilize concepts provided by electronic (or "e") paper to provide the display 130.

To this end, the piece 100 includes an electrophoretic display layer or substrate 120 and a top (or first) electrode layer 110 formed of transparent, conductive material (e.g., provides a transparent, solid or continuous electrode used for grounding display layer 120). A first or inner surface 122 of the display layer 120 is attached to and abutting an inner or mating surface 114 of the electrode layer 110. A second or outer surface 124 of the display layer 120 is exposed, and, as described later, provides an activation or data entry surface when it is placed in abutting contact (e.g., to achieve direct electrical connection) with a conductive pin layer (or bottom conductor) provided as part of an update pad of an interactive display device. The outer surface 112 of the transparent electrode layer 110 faces outward toward a user of the puzzle piece 100, and the information display 130, which is provided on the first or inner surface 122 of the display layer 120, is visible to a user through the electrode layer 110.

The universal puzzle piece 100 may be configured as an e-paper type device because this allows the layer 120 to store data or information (e.g., hold a graphical/textual image 130) without ongoing use of power. As a result, the puzzle piece 100 may be lightweight (no batteries), be relatively inexpensive to manufacture and maintain, and be relatively small in size. For example, the puzzle piece 100 is shown to have a thickness, $t_{Puzzle}$, and this may be relatively thin such as less than about 0.125 inches in most cases. The other dimensions such as height, $H_{Puzzle}$, and width, $W_{Width}$, may be varied widely to practice the invention. In some applications, the puzzle piece 100 is sized to be readily carried and handled by younger children and to take on the form of a small map or puzzle piece, e.g., a rectangle that is 4 to 10 inches in height, $H_{Puzzle}$, by 6 to 12 inches in width, $W_{Puzzle}$.

In some embodiments, the shape may be more irregular with a rectangular shape just being one, non-limiting, example of a shape for puzzle piece 100. The shape and size of the puzzle piece 100 may be matched to the shape and size of one or more update pads of interactive display devices to facilitate proper registration or alit of the puzzle piece with the bottom electrode/conductive pin layer to cause desirable results in updating the display 130 during use of the puzzle piece 100.

The puzzle piece 100 may be considered an electrophoretic display (or be electronic paper or use electronic ink) that is missing its bottom electrode or the electrode that is used to drive the display layer 120 to provide display 130. Instead, this layer is provided in an update pad of an interactive display device (as shown below). As will be understood by those skilled in the art, electrophoretic displays generally operate on the principle of electrophoresis, which is defined as the motion of a charged particle through a liquid medium due to an applied electric field. Hence, the display layer 120 includes numerous pigmented (white, black, or the like) particles suspended in small bubbles or voids containing a colloidal medium, with each of these defining a "pixel" that can be selectively operated to display a particular pigment by moving the particles (flipped from white to black or black to white).

In a typical electrophoretic image display, light and dark pigment particles are provided in a colloidal suspension with one or both of the light or dark particles being electrically charged (e.g., oppositely charged). Then, applying an electric field drives the particles to one of the two electrode surfaces such as toward the surface 122 near top transparent electrode 110 or toward outer surface 124. For example, an applied positive direct current (DC) field between the transparent electrode 110 and a bottom electrode (not part of piece but, instead, a portion of the interactive display device) placed next to surface 124 may attract white pigmented particles to the transparent electrode 110. The display layer 120 has memory when the DC field is removed due to the relatively high viscosity of the colloidal suspension of the electrophoretic layer.

In other cases, the e-ink-based display layer 120 may include millions of tiny microcapsules (e.g., bubbles/voids about the diameter of a human hair). Each microcapsule may contain positively charged white particles and negatively charged black particles suspended in a clear fluid. When a negative electric field is applied (such as via one or more conductive pins in an update pad), the white particles move to the top of the microcapsule where they become visible to the user of the puzzle piece 100. This makes the surface appear white at that spot. At the same time, an opposite electric field pulls the black particles to the bottom of the microcapsules where they are hidden. By reversing this process, of course, the black particles appear at the top of the capsule, which now makes the surface 122 appear dark at that spot or pixel of the puzzle piece 100 thus allowing the information display 130 to be provided with images/text 132 and interactive game/activity information 134, 136 associated with a first state of the game/activity in which the UPP 100 is being used by a player/user.

Figure 2:
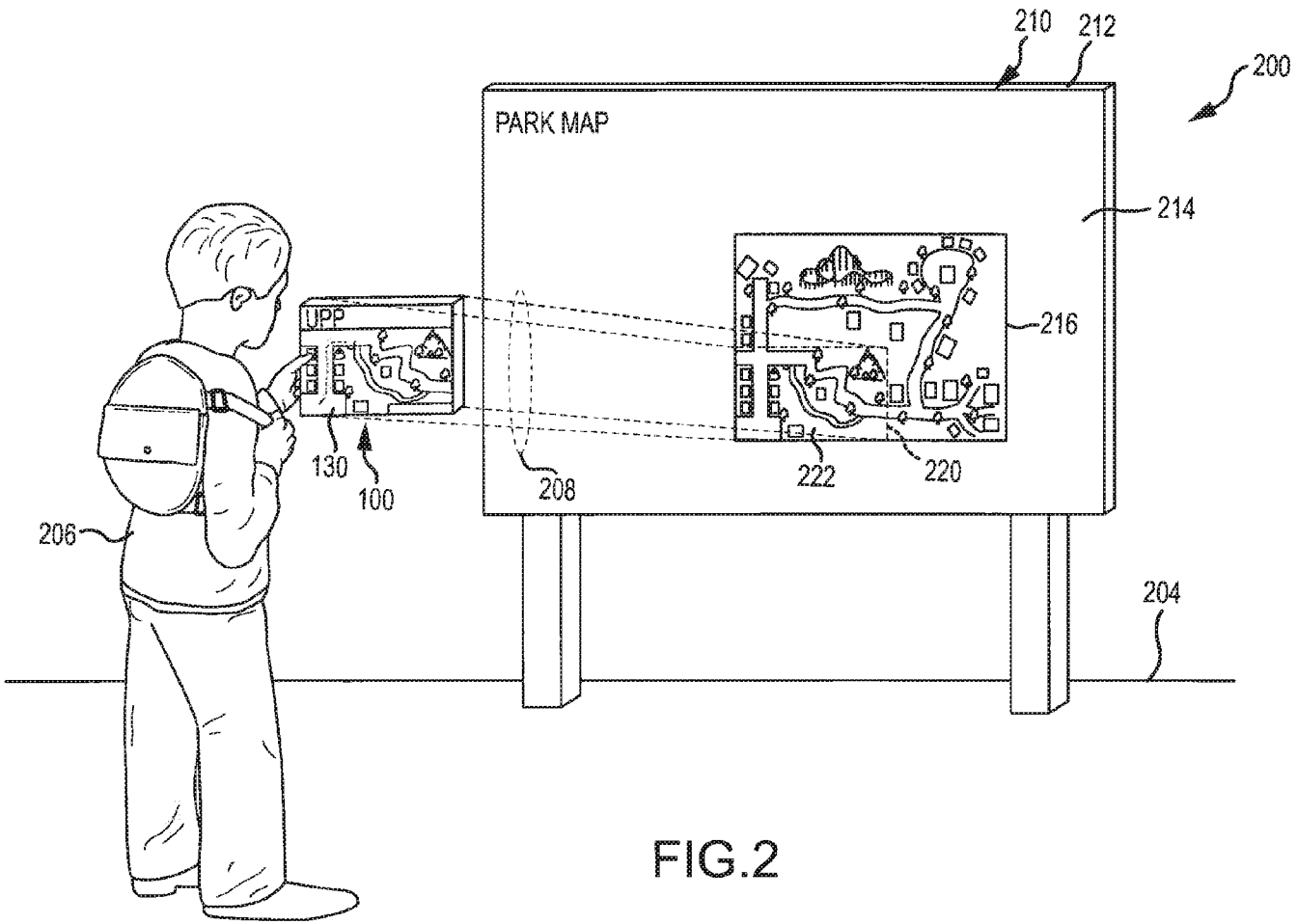
FIG. 2 illustrates an interactive entertainment system showing a player or user applying the universal puzzle piece of FIG. 1 to an update pad of an interactive display device.

FIG. 2 illustrates an interactive display system 200 in which a user or player 206 uses the universal puzzle piece 100 to interact with the venue or facility 204. For example, the user 206 may be given the puzzle piece 100 at a theme park entrance in the state shown in FIG. 1, i.e., providing the display 130 of stored game or activity data. As shown, the puzzle piece 100 of FIG. 1 is programmed or activated (e.g., using an update pad with a bottom conductor layer (or conductive pin layer) in a store or ticket booth or the like) to display a fragment of a map of the venue (or theme park). The player 206 must now find a larger map into which the map fragment of display 130 fits or is a full or partial overlay. The stored data of display 130 may include a hint or even a path 134 to the first clue or displayed map 136, which may be publically displayed anywhere in the venue 204.

The system 200 includes an interactive display device 210 with a body or support structure 212 with a front surface or sidewall 214. Significantly, the sidewall 214 includes a display surface 216 providing a docking station or puzzle piece-update pad 220 with an outer or outward-facing surface or sidewall 222. The outer surface 222 includes a map segment (or imagery/display) that matches or coincides with the display 130 of the puzzle piece 100. The display surface 216 may include alignment indicators for pad 220 or the surface 222 may be raised or recessed to assist the user 206 in aligning their puzzle piece with the update pad 220 (or the pad 220 may be relatively hidden or hard to distinguish from other portions of the display surface 216).

In any of these embodiments, though, the user 206 recognizes that the puzzle piece 100 is an overlay of the image of display 216 on update pad 222. To update the puzzle piece, the user or player 206 positions 208 the puzzle piece 100 over the matching displayed image on outer surface 222 of the update pad 220. The puzzle piece 100 is aligned with the outer or back surface 124 of the electrophoretic display layer 120 in abutting contact with the pad surface 222. In some embodiments, this achieves direct electrical connection while in others the player 206 has to apply a force to achieve such electrical connection with an insulated update conductor element (and, if required, to ground the top electrode layer 110 of puzzle piece 100).

Figure 3:
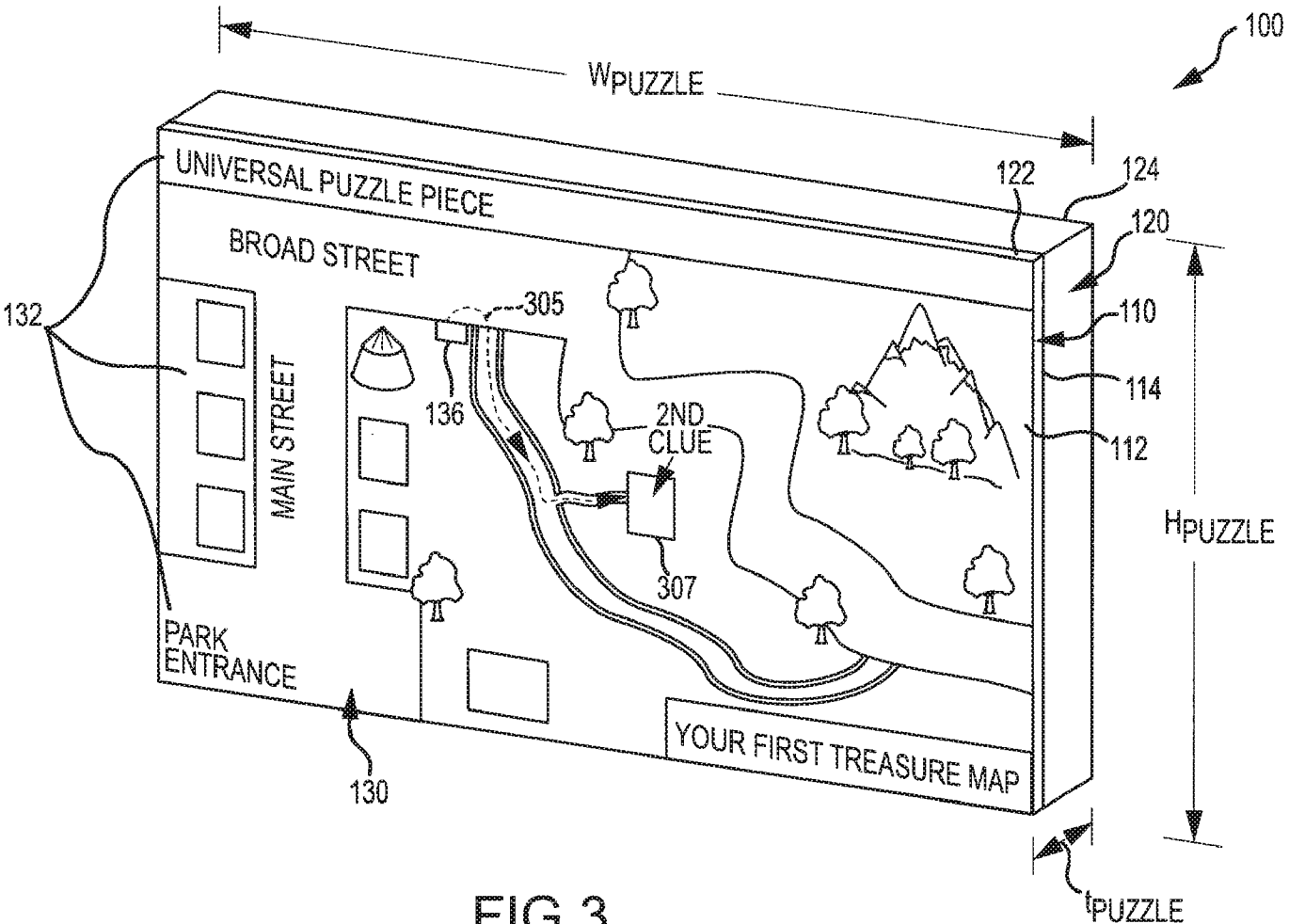
FIG. 3 illustrates the universal puzzle piece of FIG. 1 after the stored set of information is updated/modified by the update pad to alter the display (e.g., to show a next game clue or the like)

Such positioning 208 of the puzzle piece 100 allows the update pad 220 to function to update the universal puzzle piece 100 by programming or differently activating the display layer 120 to modify or update the display 130. For example, FIG. 3 shows an example of how the display 130 may be updated or changed between its first state of FIG. 1 and a second or updated state shown in FIG. 3. As shown, the initial suggested route 134 and location of the first clue 136 have been erased (old or original data in displayed information 130 is deleted or erased while other information 132 is retained).

The update pad 220, via a bottom conductor applied to display layer 120, has updated the puzzle piece to include a new or second suggested route 305 from the present location in the venue 204 to a second or next clue location 307. When the user 206 pulls the puzzle piece 100 away from the pad 220, the images and text of display 130 are retained such that the user 206 may continue to use the puzzle piece 100 as a map to a next location in the venue 204 (to a next interactive station or next clue/activity in the interactive game).

In another embodiment, the area/surface 222 of the map provided in display surface 216 may show two pathways that are parallel but not connected. When the user's UPP 100 is properly aligned with the display (map) of surface 216, however, the UPP 100 via displayed information 130 may review a secret connection between the two parallel paths. The user 206 may then go take this "secret" passageway to a next interactive station or clue. In some embodiments, the interactive display device 210 may include two or more update pads 222 such that different users 206 carrying different UPPs 100 (with differing displays 130) would update their UPPs 100 in differing parts of display surface 216 to obtain differing sets of update information. In the illustrated example, a single display surface 216 with two or more update pads 222 may be operable to differently update a variety of UPPs 100 such as by providing differing routes or map updates to different locations, clues, secret passageways, and so on.

In some embodiments, a single update pad 220 is operated by the device 210 (e.g., via a game/activity server or other computer or controller device) to provide different sets of update data to users 206 approaching the display surface 216. For example, one user 206 who applies their UPP 100 to the pad 220 may be directed or encouraged to travel to one location within the venue 206 (e.g., have a second route to a second clue that causes him to go east) while a second user 206 who applies their UPP 100 to the pad 220 may be directed or encouraged to travel to a second, differing location within the venue 206 (e.g., have a third route to a second clue that causes him to go north from device 210).

The controller/game server may perform such differing updating on an update pad 220 by selectively altering the conductive pin layer or bottom conductor of the pad 220 so as to differently program or activate the pixels or pigmented particles of the electrophoretic display layer 120. In other words, the updating of the display 130 provided by each update pad 220 of an interactive system 200 may be modified periodically or selectively by a controller of the device 210. Selection of differing update patterns may be done based on an identity of the player 206 (such as with an RFID tag in the UPP 100 linked to an identity of the player 206 and read by an RFID interrogator in device 210), based on the UPP 100 itself, via RFD tag, magnetic strip on piece 100, bar codes on piece 100, or the like, or performed randomly or in some other pattern to load balance or otherwise drive traffic of players/users 206 in the venue 204 (e.g., one portion of the park or venue 204 may be relatively inactive or quiet and it may be desirable to drive the next group of users (and their families) to that portion of the venue 204).

Figure 4A:
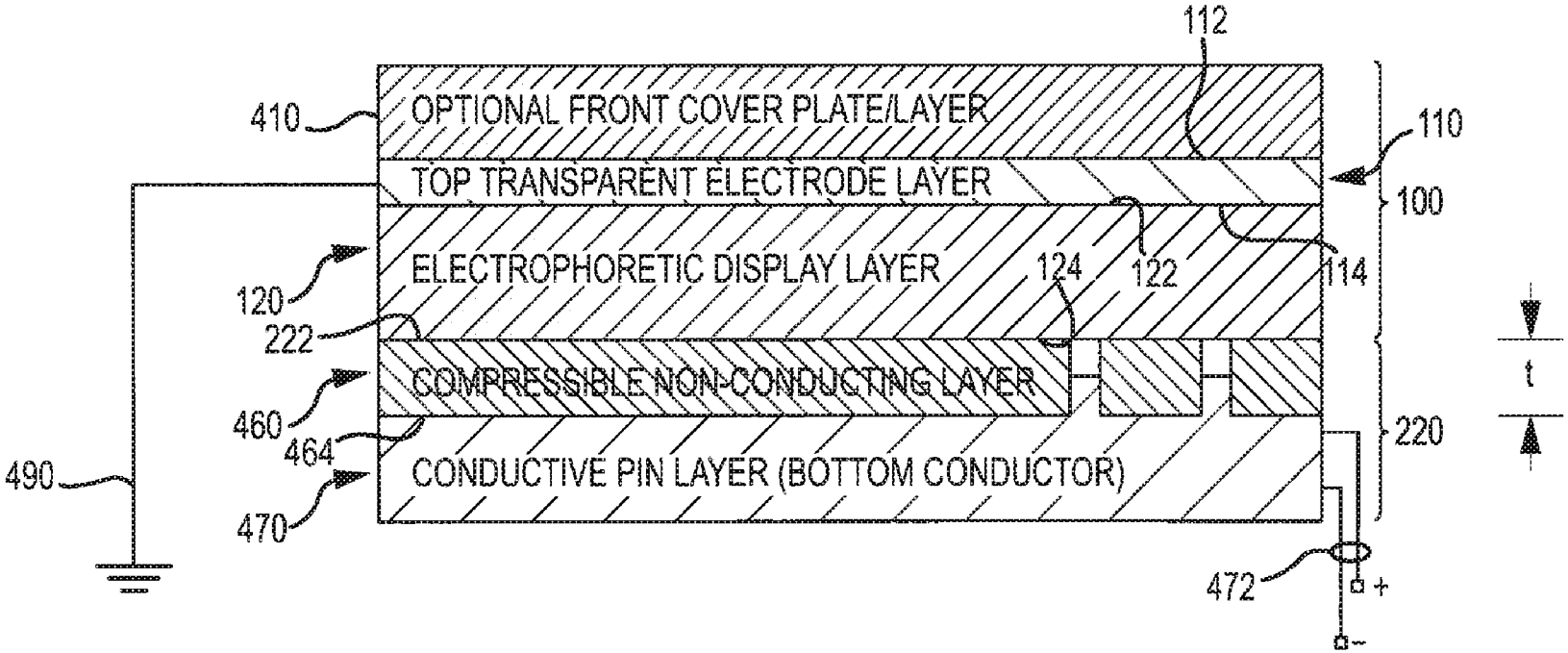
FIGS. 4A and 4B are sectional schematic views of the universal puzzle piece of FIGS. 1 and 3 and update pad of FIG. 2 showing the puzzle piece as it is initially positioned on an update pad of the interactive display device and as it is forced against the update pad so as to compress a nonconductive layer to achieve an electrical connection with a bottom conductor causing differing ones of the pixels (or pigment particles in microcapsules) to be activated (shown as a darker color, for example)
Figure 4B:
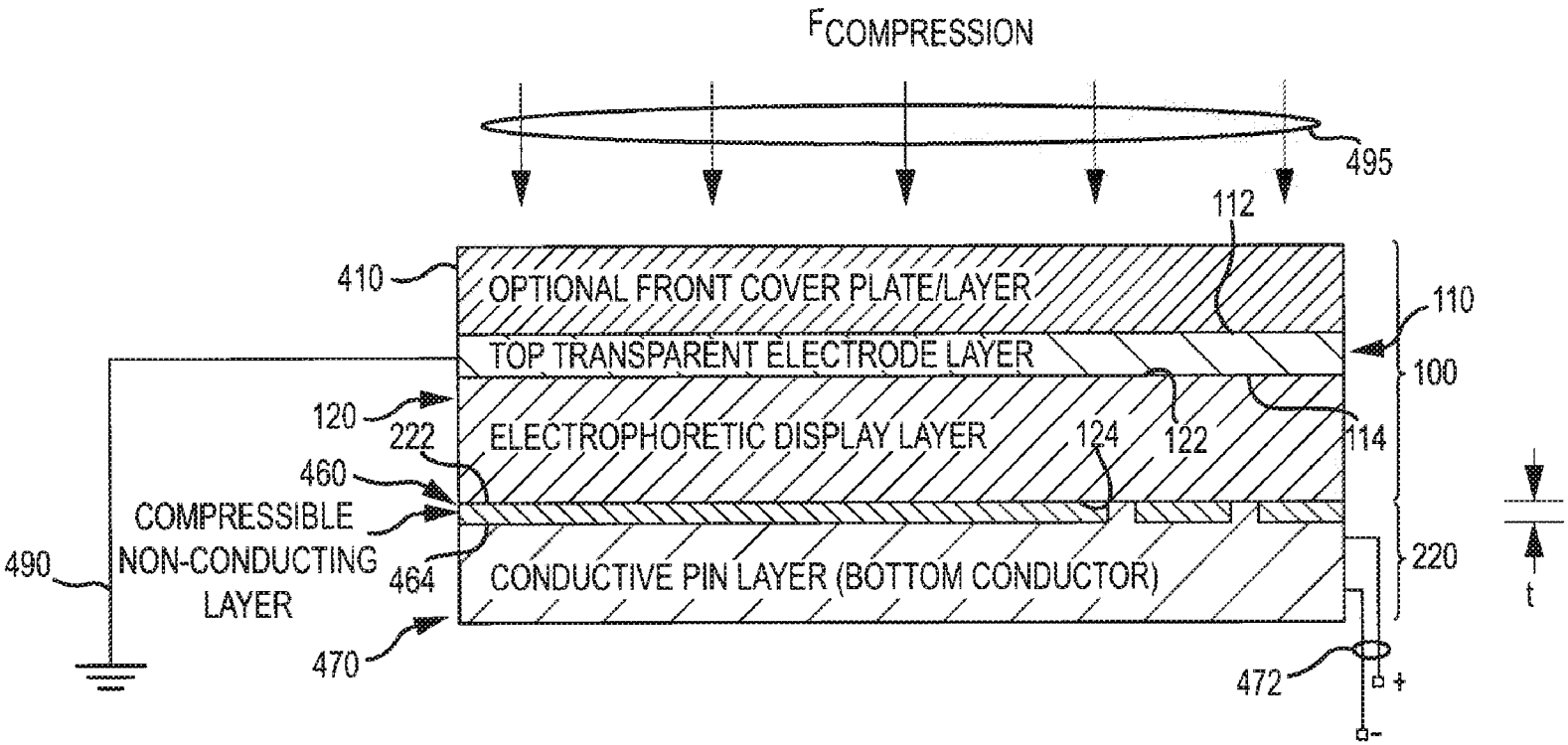

FIG. 4A illustrates a sectional view of the update pad 220 of FIG. 2 as the UPP 100 is initially positioned or aligned in contact while FIG. 4B illustrates the update pad 220 as the UPP 100 is pressed or rubbed with force, $F_{Compression}$, 495 that is adequate to reprogram or update the display layer 120. FIGS. 4A and 4B are useful for explaining one technique for programming or updating the UPP 100 according to the invention.

The "image transfer" or updating of the displayed image/information 130 may be achieved by rubbing 495 the UPP 100 against the update pad 220. To this end, as discussed above, the UPP 100 in contrast to conventional e-paper devices is missing a bottom conductor. As shown, the UPP 100 includes an electrophoretic display layer 120 (a layer containing charged pigment particles floating in fluid in microcapsules each representing a pixel or programmable portion of a display 130) with an exposed back surface 222 and an top or inner surface 122 abutting a top transparent electrode layer (or solid conductor) 110 at its inner surface 114. The UPP 100 may also optionally include a front cover plate or layer (e.g., a transparent sheet of glass, plastic, or ceramic material) 410 over outer surface 112 to protect the top electrode layer 110 during use of the UPP 100, to facilitate cleaning of the UPP 100, and/or to add rigidity to the UPP 100 that may facilitate applying the rubbing force 495 to update the layer 120.

As shown, the update pad 220 includes an array of conductive pins (or a conductive pin layer/bottom conductor) 470 (or pins on a surface of layer/conductor 470) that are arranged beneath a non-conducting layer 460. The non-conducting layer 460 is formed of a compressible material (such as a rubber or plastic material) with holes or gaps through Which the pins on layer 470 extend partially through when at rest or non-compressed (as shown in FIG. 4A) and fully through when compressed (as shown in FIG. 4B). The layer 460 has an outer surface 222 that may be painted or covered with images or text matching a UPP display or to otherwise indicate the presence of the pad 220 (e.g., covered with images matching a map in display 130 of a UPP 100). The inner surface 464 of the compressible non-conducting layer 464 may be proximate to or in contact with the pin layer 470. Then, when the UPP 100 is pressed with a force, $F_{Compression}$, 495 (such as when a user 206 applies a rubbing force with their hands), the non-conducting layer 460 is compressed from an thicker at rest thickness, $t_{At\ Rest}$, to a compressed thickness, $t_{Compressed}$, at which point an electrical connection is achieved between the pins of layer 470 and the bottom surface 124 of the electrophoretic display layer 120 (e.g., in some cases, conductive pins are exposed through the material 460 to provide direct electrical connection).

A controller (not shown in FIGS. 4A and 4B) may be used via connections 472 to apply a positive and/or a negative field to select numbers (in any pattern) of the microcapsules of layer 120 to rearrange which ones of the pigment particles are proximate to surface 122 (e.g., to rearrange the white and black pigmented charged particles in layer 120) to create an updated display 130 with images and/or text. For example, each of the conductive pins in layer 470 may be individually addressable so that the charge on any or all of the pins may be changed, thereby changing the areas of the electrophoretic display layer 120 that are encoded (or programmed for inclusion in display 130 of UPP 100).

The top transparent electrode layer 110 of the UPP 100 is shown to be grounded at 490. For example, the update pad 220 may include a grounding frame such that when the UPP 100 with the transparent electrode, layer 110 is placed onto the flexible non-conducting surface 222 of layer 460 the frame 490 grounds the upper layer 110. In some embodiments, the grounding 490 may be accomplished by the user's fingers if he were given a reason to touch some other conductor while touching the layer 110, such as to touch a cover or adjacent feature of the update pad 220 or compressible layer 460.

As shown in FIGS. 4A and 4B, nothing would happen to the display layer 120 unless the UPP 100 is pressed 495 with a finger or the like at or above a predefined compression force, $F_{compression}$, for the layer 460 to expose the conductive pins of layer 470 below the layer 460. When a pin that has been charged comes into contact with the surface 124 of the electrophoretic display layer 120, it would switch the display material in the layer 120. The process of "rubbing" the UPP 100 would give the impression to a user that they magically transferred the new information or image to the display 130 (e.g., they somehow transferred a secret image to the UPP 100 even though the new information in the UPP 100 is not visible to the naked eye when viewing the update pad 220).

Figure 5B:
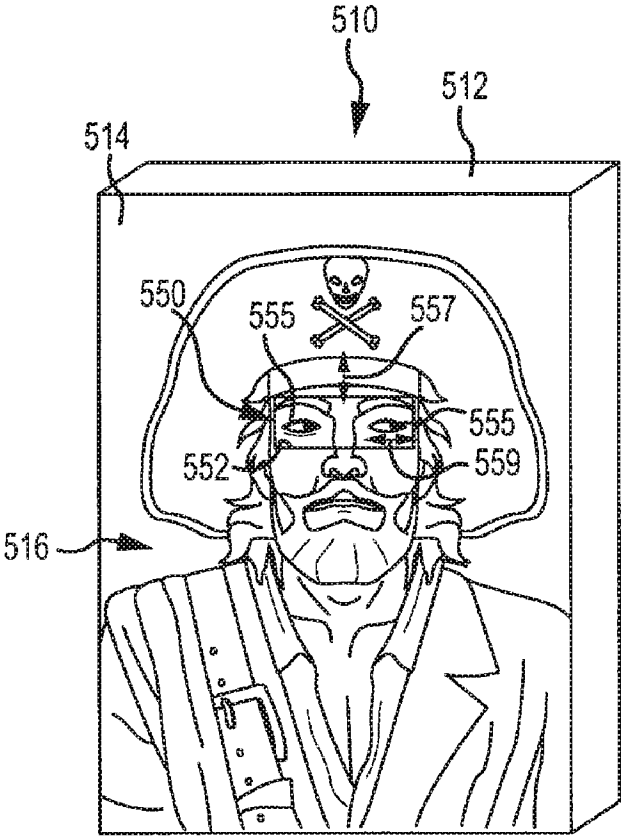
FIGS. 5A and 5B illustrate, respectively, an example of an interactive display device and the interactive display device after a universal puzzle piece has been positioned on an update pad of the interactive display device causing the image provided by the display device to be altered (and, in some cases, animated)
Figure 5A:
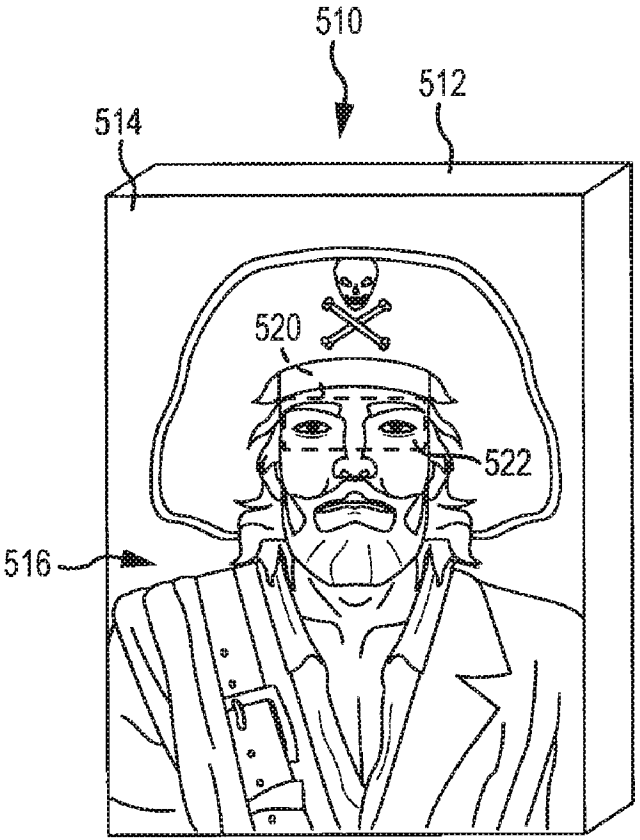

FIGS. 5A and 5B illustrate another use of a universal puzzle piece 550 of the present invention. The UPP 550 is configured to be used as an overlay for a picture such as a portrait of an animal, person, or character. The interactive display device 510 includes a body or frame 512 with a display surface 514 that includes a portrait 516 or similar image of a person (e.g., a pirate in this case). The display surface 514 includes an update pad 520 with an outer surface 522 (outer surface of a compressible, non-conductive material layer covering a bottom conductor that may include selectively charged pins or the like) that is configured to appear to be a portion of the portrait or imagery 516 of display surface 514.

In this example 510, the surface 522 of update pad 520 provides a set of eyes that may be looking a first direction (e.g., to the pirate's right) in a first state. A user with a puzzle piece may find the portrait 516 in an interactive entertainment system and discover that the eyes on the UPP 550 match those of the eyes on surface 522 (be in the first state), e.g., due to the prior programming of an included e-ink layer for example. A user may then press the UPP 550 into place on the surface 522, and, as needed, apply a compressive force to achieve an electrical connection with a bottom or second conductor to reprogram or update the e-ink layer of the UPP 520. This connection with pad 520 causes the eyes 555 (or display of the UPP 550) to be modified or updated to a second state such as with the pirate of portrait 516 now looking to his left. This may encourage the user of the UPP 550 to go in that direction for a next clue or interactive activity. Again, other users' may have different UPP 550 that interact with different update pads 520 of device 510 or other UPP 550 may be reprogrammed or updated differently than shown in FIG. 5B.

In some embodiments, it may be useful to have the updating include animation of one or more portions of the display provided by the UPP. Such animation may be achieved by a controller operating the bottom conductor or conductive pin layer of the update pad so as to selectively change the charges of areas of this layer while the UPP is held in an electrical connection with the update pad. Such an embodiment is shown in FIG. 5B with the UPP 550 in electrical connection with the update pad 520 the bottom conductor is operated to animate the eyes 555 as shown with arrow 559 to move to the left and back to the center (and then again to the left such as to encourage the user to look or go in that direction). Additional animation is shown at 557 such as with the pirate's eyebrows moving up and down or changing shape while the UPP 550 is in place against the update pad 520 (or for a portion of that contact time).

Figure 6A:
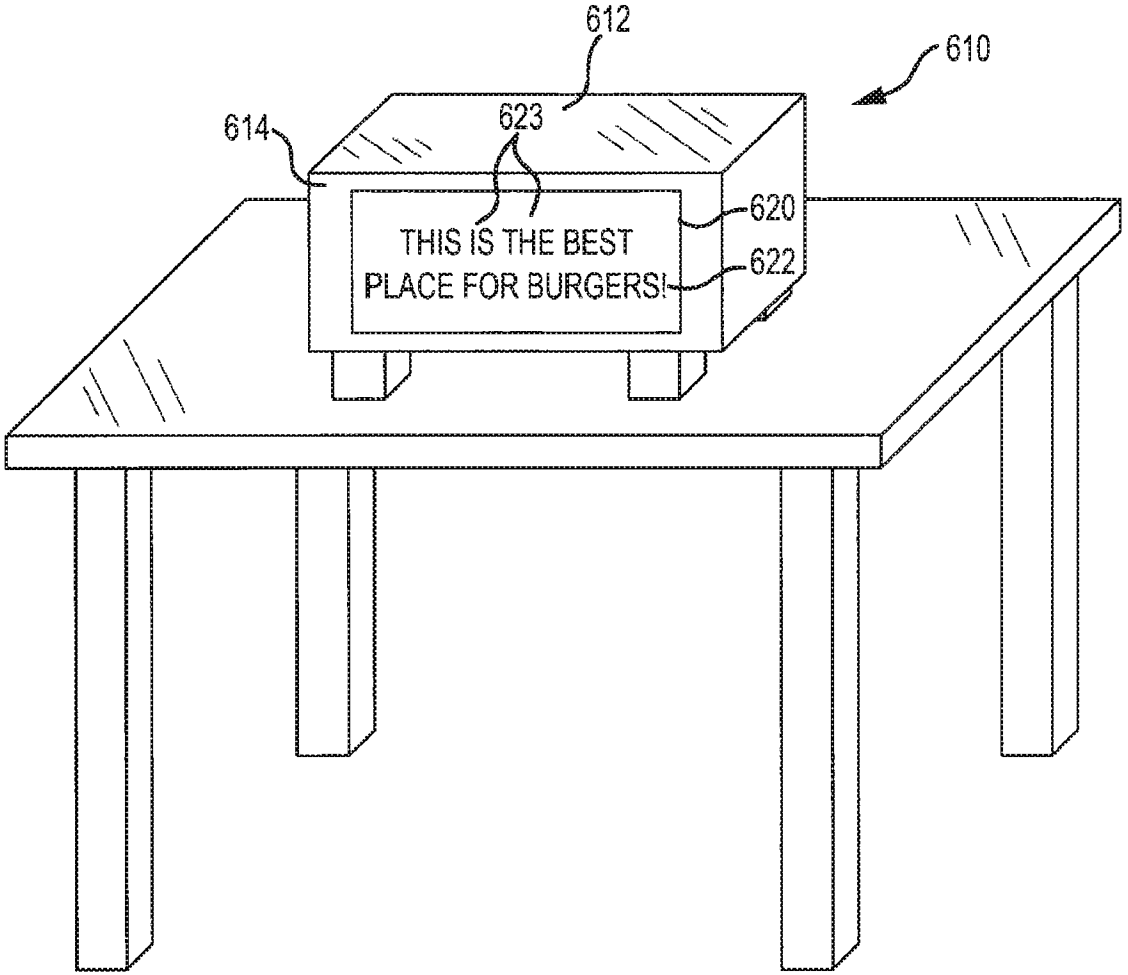
FIGS. 6A and 6B illustrate, respectively, another example of an interactive display device before and after a universal puzzle piece has been positioned on an update pad of the interactive display device causing a text-based message provided by the display device to be altered or updated.
Figure 6B:
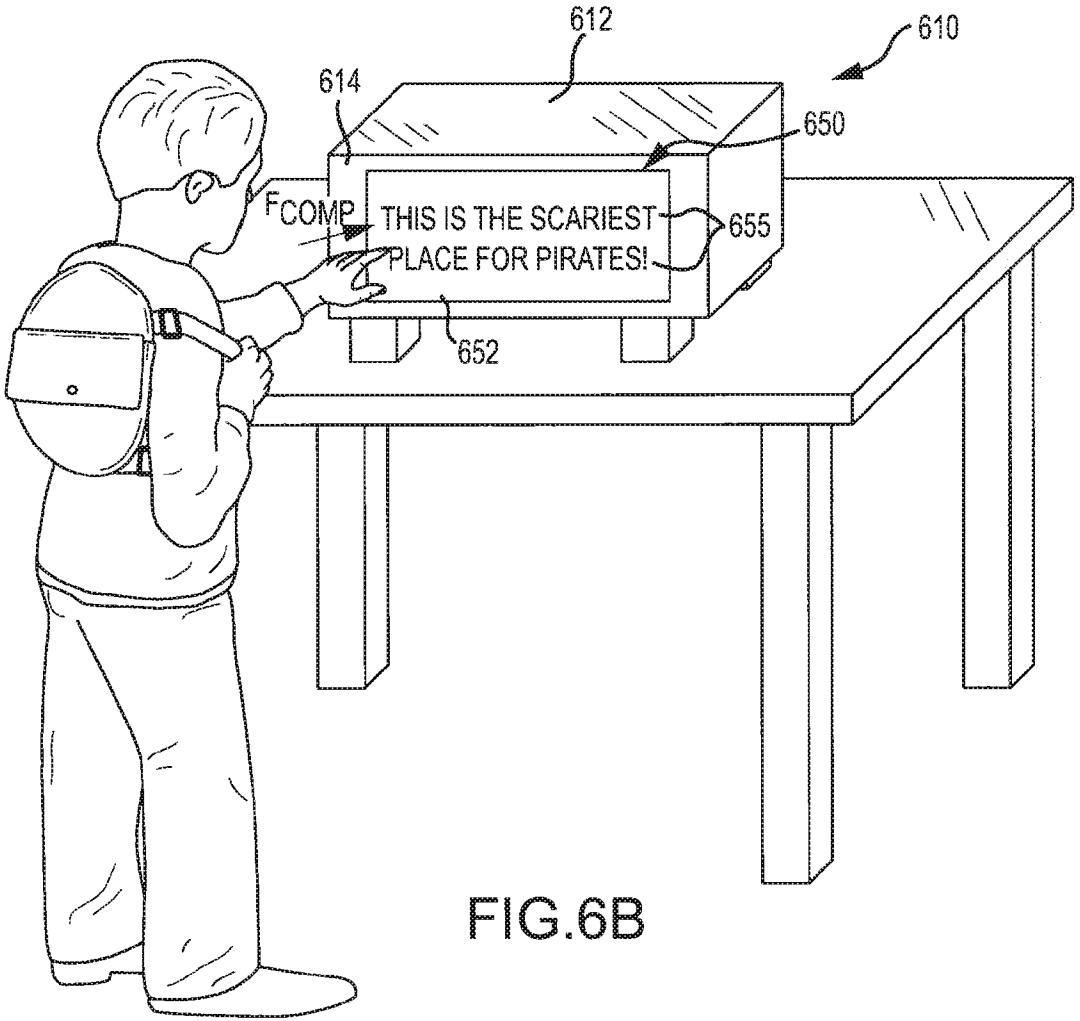

The prior examples have mainly stressed updating or changing images displayed by a universal puzzle piece, but the displayed information may also include or be solely textual in nature. For example, a UPP may be used by a user to modify a displayed message such that the user may receive a differing message or information for a game/activity. For example, FIGS. 6A and 6B illustrate an interactive display device 610 before and after, respectively, the application of a UPP 650. The device 610 includes a body or frame 612 with a display surface 614 that contains an update pad 620, The update pad 620 is shown with its outer surface 622 (outer surface of a compressive layer for example) having a printed or otherwise provided text message ("This is the best place for burgers."). The message 623 on surface 622 may be a publically displayed instruction, menu, signage, or the like that may be modified partially or fully by applying a UPP 650.

In FIG. 6B, the user has applied a compressive force, $F_{Comp}$, to push the UPP 650 against the pad 620 and obtain electrical connection with the back surface of the UPP 650. The pad 620 is operated (select charging of conductive pins or the like) to cause the display 652 of UPP 650 to include text 655 that updates the message 623 (e.g., message displayed now states "This is the scariest place for pirates!") by changing one or more letters/words/sentences. The UPP 650 may, for example, be updated or programmed by update pad 620 of interactive display device 610 to change the displayed message's 623 meaning depending on the context of the game/activity being participated in by the user/player.

Figure 7:
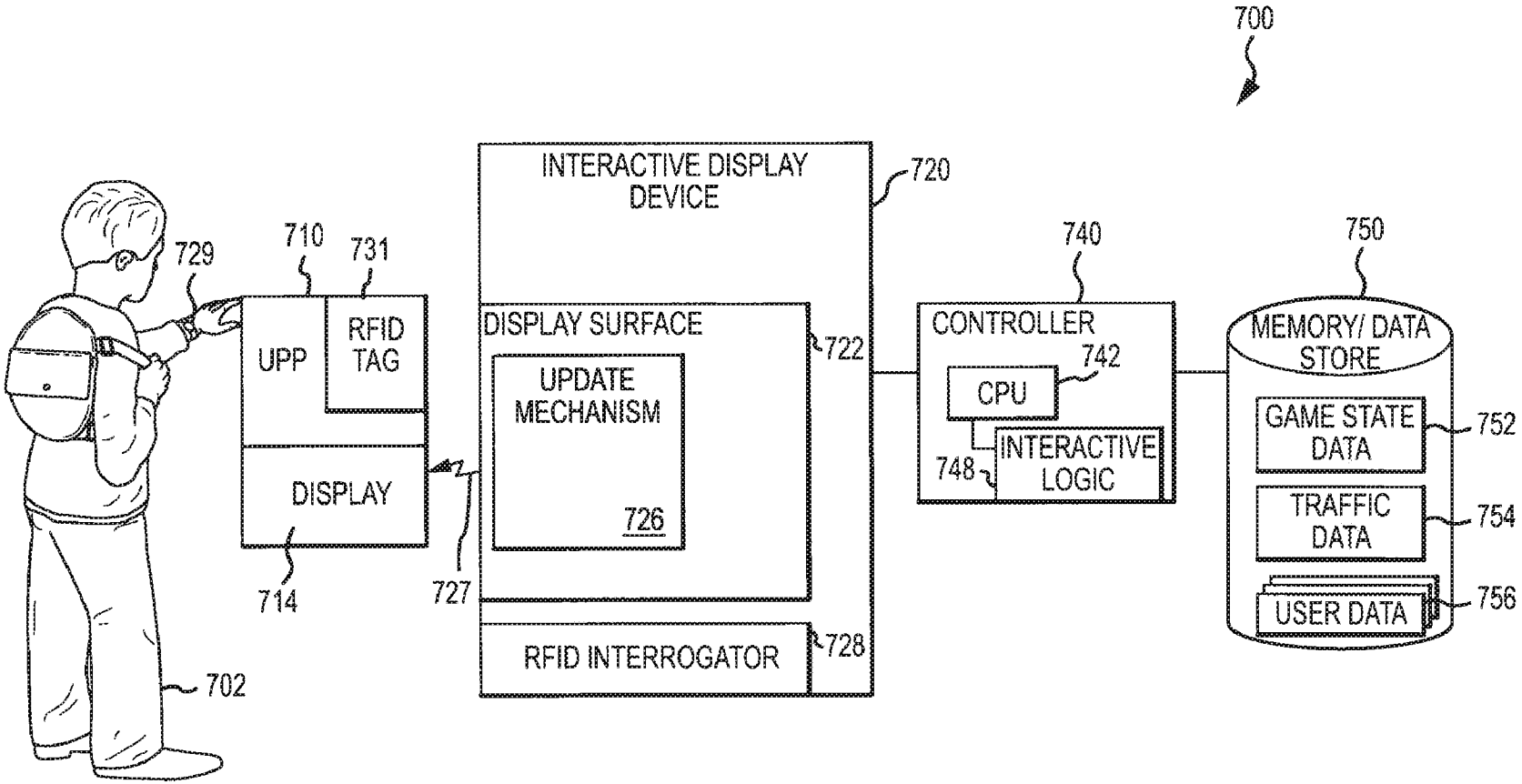
FIG. 7 is a functional block diagram of an interactive entertainment system of an embodiment of the invention.

FIG. 7 illustrates an interactive entertainment system 700 of an embodiment of the invention such as one that may make use of the universal puzzle pieces and display devices shown in FIGS. 1-6B. As shown, the system 700 includes a universal puzzle piece 710 that may be provided to and used by a user 702 (e.g., a person visiting an amusement or theme park or other interactive facility). The puzzle piece 710 includes a display surface or screen (e.g., a top surface of an electrophoretic display layer visible through a transparent top conductor or electrode layer) upon which interactive information in the form of images and/or text may be displayed to the user 702.

With this in mind, the system 700 includes an interactive display device 720 that includes a display surface 722 with an update mechanism 726. The update mechanism 726 is operable by a controller 740 to update (as shown with communications/signals 727) the UPP 710 to update or program the display 714 (e.g., to update or modify a displayed image/text). The controller 740 may be nearly any electronic device (such as a computer or computer-based device) with a processor 742 operating to run or function based on interactive logic 748. The logic 748 may be computer program or code that is stored in local or accessible memory and run by the CPU 742 to cause the processor and/or controller 740 to perform the functions described herein including selectively controlling operation of the update mechanism 726 to update 727 the display 714 (e.g., to change which set of conductive pins are charged in an update pad 726 to modify image/text in display 714).

The system 700 includes memory or a data store 750 accessible by the controller 740 via wired or wireless communications such as based on control by the interactive logic 748. For example, the logic 748 may be configured to control the update mechanism 726 based on the context or state of a particular game/interactive activity that is defined by a set of game state data 752. In other cases or additionally, the logic 748 may access venue traffic data 754 to determine which portions of a venue are not busy and, in response, determine to update 727 a display 714 so as to direct the user 702 toward this not busy portion of the venue (e.g., display a different clue or route to a next clue to drive traffic in the venue based on traffic data or to achieve a different goal).

In other cases or additionally, the logic 748 may operate the update mechanism 726 to update 727 the display 714 based on user data 756. For example, the user 702 may be at a particular level of a game or have already gathered one or more clues/awards/points, and in response, the logic 748 may update 727 the display 714 based on such user data. The user data 756 may also provide other user data such as gender and/or age of the user 702, and the logic 748 may operate the update mechanism 726 to update 727 the display 714 based on such user-specific data (e.g., provide clues to a pre-teen that urge them to one part of a venue while younger visitors 702 are urged via updates 727 to the display 714 to travel to a different part of the venue or a text message may be modified as shown in FIGS. 6A. and 6B based on user-specific data (e.g., a young boy may get one message while a young girl is provided another and so on)). The user 702 may be linked to the UPP and the user data 756 in a number of ways such as the display device 720 using a radio frequency identification (RFID) interrogator 728 to activate or query an RFID tag (or pin, bracelet, or the like) 729 worn by the user 702 or an RFID tag/chip 731 provided on the UPP 710.

The UPP 710 may include an electrophoretic display 714 as discussed above with reference to FIGS. 1-6B. In other cases, though, the UPP 710 includes another type of electronic display 714 such as an LCD display, a display screen of a wireless communication device, a display of a portable game console, or nearly any other device that is useful for at least temporarily holding a graphic image/text (i.e., interactive activity or game information). In these embodiments, the update mechanism 726 may include a port or docking station suited for digital communications with the display 714 in a wired manner. In other cases, the update mechanism 726 may be a wireless communication device providing wireless communications/signals 727 causing the display 714 to update its graphic image. The update mechanism 726 may include a processor running an application that may communicate with the controller 750 (e.g., entertainment system server or the like in a theme park or other venue) that loads puzzle images (or information updates) such as to suit a particular moment or context of a game/interactive activity (e.g., based on state data 752 or user data 756). The puzzle images/updates 727 may reflect a GPS-determined position of the user 702 or piece 710, a time of day, a point in a story/game, or other interactivity parameters used by system 700.

The above described invention including the preferred embodiment and the best mode of the invention known to the inventor at the time of filing is given by illustrative examples only. It will be readily appreciated that many deviations may be made from the specific embodiments disclosed in the specification without departing from the spirit and scope of the invention. The RFID components described herein may take numerous forms to practice the invention. For example, the tags may be standards-based RFID tags such as the FeliCa™ or MiFare™ RFID chips, Taggit™ passive RFID tags, active RFID tags, or similar technology available from Sony Corporation, NXP Semiconductors, Texas Instruments, Inc., Axcess International, Inc., and others. Each RFID tag may include an integrated circuit storing and processing information, modulating and demodulating an RF signal, and providing other useful functions such as providing tag memory or data storage. Each tag may further include an antenna for receiving and transmitting signal or broadcasts to RFID readers or the like. With the active RFID tags, a battery may be provided that is used to power the tag and, in some cases, the computing device. In the passive RFID tags, no battery is provided typically and an external source (e.g., the RED reader) is used to provoke signal transmission (energize the tag to allow reading of the tag memory). The amount of data stored in the memory or data storage of each RFID tag may also vary and range from a plurality of bits (such up to 80 bits or more) to a larger number of bytes (such as up to 8 to 16 bytes or more). The range of the RFID tags (or distance between an RFID reader and the tags for successful data transmission) may also vary and range, for example from less than about 60 centimeters to several up to many meters.

The interactive entertainment/game system may be implemented in a variety of manners, too, and the communication devices and methods are not limited to a particular interactive system or station/installation configuration. For example, the interactive entertainment systems may be configured according to the teaching of U.S. Patent Appl. Publ. No. US 2008/0039206 by Ackley et al., which is incorporated herein in its entirety. As noted in this published patent application, interactive installations may communicate with a game server (and/or with a location server and/or content server) over data links and according to one or more available communication protocols. For example, data packets may be used to transmit information between a game server and an interactive installation in connection with information received from an input device/RFID reader (based on communications with a participant's communication device) or provided to an output/display device. Here, such communication may be enabled with Internet Protocol infrastructure supporting the use of IMP, TCP/IP, HTTP and/or the like. According to an embodiment, interactive installations or stations may be integrated with an interactive gaming system as "atomic" entities such that elements of an interactive installation/station are integrated with a game/entertainment server (and/or a location server and content server) over a single communication interface. For example, communication between an energizer/reader pair RFID reader/wireless communication device) and interactive system servers.

According to an embodiment, a game or system participant may be associated with a communication device (e.g., have record in a database accessible by the game server that has fields that link a participant ID with a UID of a communication device or the like). The communication device may be adapted to communicate with a game or entertainment/interactivity server via an RFID reader (and a station engine and CPU/controller), which then may use a wired or wireless communication network using communication protocols such as, for example, email (including POP3 and/or SMTP), Wireless Application Protocol (WAP), Wireless Web, HTTP, TCP/IP, SIP, real-time streaming protocol (RSTP), IMAP, MMS, just to name a few.

We claim:

1. An interactive entertainment system, comprising:

a puzzle piece including an updatable display displaying a first graphic image when in a first position; and an interactive display device including a display surface displaying an interactive image, the display surface including an update mechanism operating, when the puzzle piece is in a second position proximate to the interactive display device, to program the updatable display to change the first graphic image into a second graphic image, wherein the puzzle piece is selectively positionable in either the first position so as to be spaced apart from the interactive display device or in the second position.

2. The system of claim 1, wherein the updatable display includes an electrophoretic display layer storing the second graphic image and includes a transparent electrode layer on a first side of the electrophoretic display layer, wherein the update mechanism comprises an update pad for receiving a second side of the electrophoretic display layer, opposite the first side, and wherein the update pad includes a conductor layer providing an electrical connection with the second side to provide the update to the first graphic image.

3. The system of claim 2, wherein the update pad further includes a layer of non-conductive, compressible material covering at least portions of the conductor layer such that the electrical connection is formed when a puzzle piece is pressed against the non-conductive, compressible material layer to reduce a thickness of the non-conductive, compressible material layer a predefined amount.

4. The system of claim 3, wherein the conductor layer comprises an array of conductive pins that are each selectively operable to have an electric charge to provide the second graphic image.

5. The system of claim 3, wherein the display surface includes a graphic design and wherein an outer surface of the non-conductive, compressible material layer includes imagery providing a subset of the graphic design of the display surface and wherein the first graphic image corresponds to the imagery on the outer surface.

6. The system of claim 2, wherein the updating mechanism includes a frame adjacent the update pad for contacting and grounding the transparent electrode layer.

7. The system of claim 1, wherein the first graphic image includes a first set of images and a second set of images and wherein the updating of the first graphic image includes replacing the second set of images with a third set of images such that the second graphic image includes the first set of images and the third set of images.

8. The system of claim 7, wherein the third set of images is animated while the puzzle piece is in the predefined proximate position.

9. The system of claim 1, wherein the first graphic image includes a text-based message and wherein the second graphic image includes a portion of the text-based message and an additional set of text that combined with the portion of the text-based message provides a new text-based message.

10. An interactive entertainment system, comprising:

a puzzle piece including an updatable display displaying a first graphic image; and an interactive display device including a display surface displaying an interactive image, the display surface including an update mechanism operating, when the puzzle piece is in a predefined proximate position, to program the updatable display to update the first graphic image into a second graphic image, wherein the updatable display includes an electrophoretic display layer storing the second graphic image and includes a transparent electrode layer on a first side of the electrophoretic display layer, wherein the update mechanism comprises an update pad for receiving a second side of the electrophoretic display layer, and wherein the update pad includes a conductor layer providing an electrical connection with the second side to provide the update to the first graphic image.

11. The system of claim 10, wherein the update pad further includes a layer of non-conductive, compressible material covering at least portions of the conductor layer such that the electrical connection is formed when a puzzle piece is pressed against the non-conductive, compressible material layer to reduce a thickness of the non-conductive, compressible material layer a predefined amount.

12. The system of claim 11, wherein the conductor layer comprises an array of conductive pins that are each selectively operable to have an electric charge to provide the second graphic image.

13. The system of claim 11, wherein the display surface includes a graphic design and wherein an outer surface of the non-conductive, compressible material layer includes imagery providing a subset of the graphic design of the display surface and wherein the first graphic image corresponds to the imagery on the outer surface.

14. The system of claim 10, wherein the updating mechanism includes a frame adjacent the update pad for contacting and grounding the transparent electrode layer.

15. An interactive entertainment system, comprising:

a puzzle piece including an updatable display; and an interactive display device including a display surface including an update mechanism, wherein the updatable display of the puzzle piece is in a first operating state when spaced apart from the update mechanism and wherein the updatable display of the puzzle piece, when moved into a predefined proximate position relative to the update mechanism, is modified by the update mechanism into a second operating state.

16. The system of claim 15, wherein the updatable display includes an electrophoretic display layer storing differing graphic images for display in the first and second operating states.

17. The system of claim 16, wherein the updatable display further includes a transparent electrode layer on a first side of the electrophoretic display layer, wherein the update mechanism comprises an update pad for receiving a second side of the electrophoretic display, opposite the first side, and wherein the update pad includes a conductor layer providing an electrical connection with the second side to switch the updatable display from the first operating state to the second operating state.

18. The system of claim 17, wherein the update pad further includes a layer of non-conductive, compressible material covering at least portions of the conductor layer such that the electrical connection is formed when a puzzle piece is pressed against the non-conductive, compressible material layer to reduce a thickness of the non-conductive, compressible material layer a predefined amount.

19. The system of claim 18, wherein the conductor layer comprises an array of conductive pins that are each selectively operable to have an electric charge to provide the second graphic image.

20. The system of claim 18, wherein the display surface includes a graphic design and wherein an outer surface of the non-conductive, compressible material layer includes imagery providing a subset of the graphic design of the display surface and wherein the second operating state corresponds to the imagery on the outer surface.

* * * * *